US005972282A

United States Patent [19]

Aguirre et al.

[11] Patent Number: 5,972,282

[45] Date of Patent: Oct. 26, 1999

[54] STRAIGHT HEARTH FURNACE FOR TITANIUM REFINING

[75] Inventors: Carlos E. Aguirre, Lake Oswego; Steven H. Reichman, Portland; Leonard C. Hainz, II, Albany, all of Oreg.

[73] Assignee: Oregon Metallurgical Corporation, Albany, Oreg.

[21] Appl. No.: 09/085,635

[22] Filed: May 27, 1998

Related U.S. Application Data

[63] Continuation-in-part of application No. 08/935,803, Aug. 4, 1997.

[51] Int. Cl.[6] ..... C21C 7/10; C21C 1/00; C21B 11/10

[52] U.S. Cl. ..... 266/208; 266/207; 266/241; 75/10.64

[58] Field of Search ..... 75/10.19, 10.64, 75/10.65; 164/506, 512; 266/207, 208, 241

[56] References Cited

U.S. PATENT DOCUMENTS

| | | | |
|---|---|---|---|
| 3,343,828 | 9/1967 | Hunt | 266/34 |
| 4,190,404 | 2/1980 | Drs et al. | 425/8 |
| 4,750,542 | 6/1988 | Harker et al. | 164/506 |
| 4,823,358 | 4/1989 | Aguirre et al. | 164/506 |
| 4,961,776 | 10/1990 | Harker | 75/10.19 |
| 5,171,357 | 12/1992 | Aguirre et al. | 75/10.19 |
| 5,222,547 | 6/1993 | Harker | 266/149 |
| 5,454,424 | 10/1995 | Mori et al. | 164/469 |
| 5,503,655 | 4/1996 | Joseph | 75/10.19 |

FOREIGN PATENT DOCUMENTS

| | | |
|---|---|---|
| 0124667A2 | 11/1984 | European Pat. Off. . |
| 0896197A1 | 2/1999 | European Pat. Off. . |
| 63-273555 | 11/1988 | Japan . |
| 2207225 | 1/1989 | United Kingdom . |
| WO90/00627 | 1/1990 | WIPO . |

*Primary Examiner*—Scott Kastler
*Assistant Examiner*—Tima McGuthry-Banks
*Attorney, Agent, or Firm*—Townsend and Townsend and Crew LLP

[57] ABSTRACT

A cold hearth furnace for refining of selected metals, such as titanium, is described. The furnace includes a melting hearth and a transport hearth arranged linearly. A pair of barriers partially block the flow of molten materials to mix it, allowing impurities to vaporize and preventing splattering of the material in the melting hearth from contaminating the final product.

29 Claims, 8 Drawing Sheets

STRAIGHT HEARTH FURNACE FOR TITANIUM REFINING

CROSS REFERENCE TO RELATED APPLICATION

This patent application is a continuation-in-part of U.S. application Ser. No. 08/935,803, entitled "Straight Hearth Furnace for Titanium Refining," and filed Aug. 4, 1997.

BACKGROUND OF THE INVENTION

This invention relates to cold hearth refining and casting of titanium and other metals. In particular the invention relates to a technique for refining titanium from various raw materials in an improved cold hearth furnace. During the melting elements may be added to the titanium to achieve a desired alloy.

One well known technique for refining titanium is cold hearth refining. In cold hearth refining, the desired raw unpurified titanium source, for example, titanium scrap, titanium sponge, or other titanium containing material, is introduced into a furnace. Typically, the furnace operates in a vacuum or a controlled inert atmosphere. The titanium is then melted, for example, using a desired energy sources such as electron beam guns or plasma torches. As the molten titanium passes through the furnace, undesirable impurities evaporate, sublimate, dissolve or sink to the bottom of the skull.

Cold hearth refining is referred to as such because of the use of a water-cooled copper hearth. During operation of the furnace, cold hearth solidifies the molten titanium in contact with the cold surface into a skull of the material being melted. In a typical furnace the hearth of the furnace is fabricated from copper, with channels in the copper carrying water to cool the copper and prevent it from melting. The molten titanium being refined then flows across the solidified titanium skull, which becomes the conduit.

One problem which can occur in cold hearth refining is splattering of the titanium being melted from the melting zone into the zone of the furnace in which the titanium is cast. This splattering can introduce impurities into the final product.

In one prior art patent describing a technique for titanium refining, a furnace is employed in which the melting segment is angled with respect to the refining segment of the furnace. In this angled furnace, a splatter barrier is employed to prevent titanium splatter from circumventing the refining process by having the cold hearth transport the molten metal around the barrier. See U.S. Pat. No. Reissue 32, 932, entitled "Cold Hearth Refining." An unfortunate disadvantage of such systems is that they require a large melt chamber volume. Because the furnace operates in a vacuum or reduced pressure environment, excessive chamber volume contributes significantly to cost, and makes cleaning more difficult.

SUMMARY OF THE INVENTION

The cold hearth furnace of this invention provides an improved purification system and technique. The cold hearth furnace of the preferred embodiment has multiple segments which are connected together in a linear manner. The furnace includes a melting hearth in which the titanium is melted using desired energy sources, for example, electron beam guns. The molten titanium flows from the melting hearth into a transport hearth. Barriers are introduced into the flow path at a desired location in the transport hearth.

These barriers extend into the molten titanium to cause it to flow in a circuitous manner as it traverses the hearth. This provides improved mixing of the controlled flow of the titanium, enabling volatile undesirable impurities to be vaporized or dissolved, while high density impurities sink to the bottom of hearth. After circumnavigating the barriers, at the end of the transport hearth, a casting zone is provided where the molten titanium flows into a mold, or other desired structure, for solidification.

In one embodiment a cold hearth furnace comprises a first segment into which raw material is introduced to be melted. A second segment is provided which is connected to the first segment to receive the melted raw material from the first segment. The first and second segments are arranged linearly. The second segment flows into a mold or receptacle for solidification. A first and a second barrier are disposed between the first segment and the mold, with each barrier extending from opposite sides of the hearth into the flow of the molten titanium. The barriers overlap each other at the center of the hearth forming a splatter shield. Together the barriers cause the molten material to flow in a non linear pattern between the first segment and the receptacle. In some embodiments of the invention the barriers also cause the molten titanium to cascade over a ledge to further mix the titanium and remove impurities.

In another embodiment of the invention a method of refining an impure metal includes the steps of introducing the impure metal into a cold hearth furnace maintained in a controlled environment, the furnace having a melting hearth into which the raw material is introduced to be melted. A transport hearth is connected to the melting hearth, with the two hearths arranged linearly. At a desired location in the melting hearth the molten material is forced to flow in a circuitous manner to create further turbulence. Throughout the furnace vapors are extracted which are formed from impurities in the molten metal. After passing through the transport hearth, the molten metal is deposited into a mold or other receptacle where it is cooled to solidify it.

DESCRIPTION OF THE SPECIFIC EMBODIMENTS

Figure 1A:
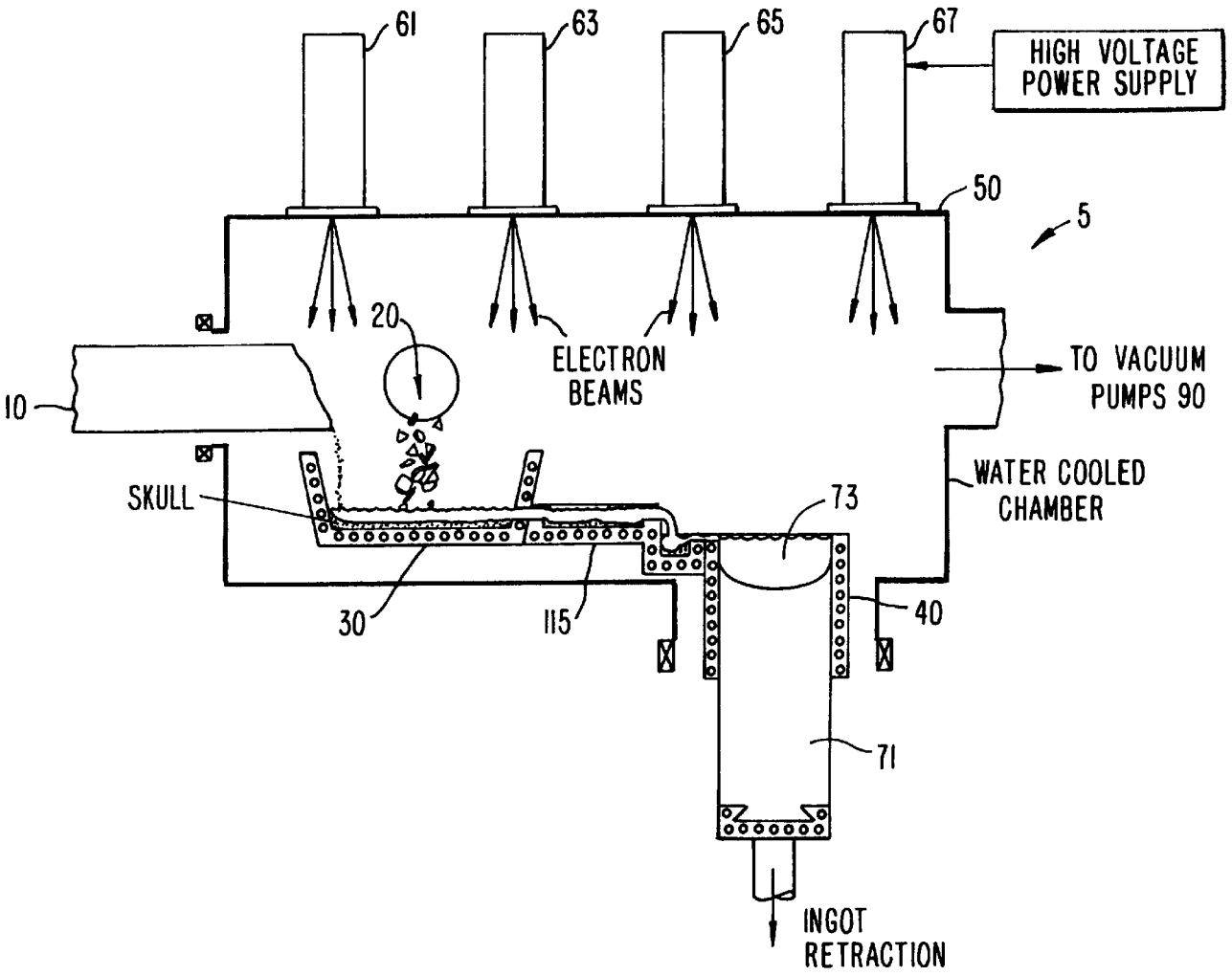
FIG. 1*a* is a schematic diagram illustrating an embodiment of the invention.

FIG. 1*a* is a schematic drawing which illustrates the conceptual arrangement of a cold hearth furnace 5 according to an embodiment of the invention. Raw material which contains titanium, and is typically relatively purer, is introduced into furnace 5 using a bar feeder 10 or a bulk feeder 20. The titanium falls into a water-cooled copper melt hearth 30 where it is heated to at least its melting point by electron beam buns 61, . . . , 68, of which four are illustrated. The titanium is melted and flows through a water-cooled transport hearth 115 and ultimately into a water-cooled mold or crucible 40 where the then molten titanium 73 solidifies into an ingot 71. As will be described in further detail below, this process purifies the titanium.

Figure 1B:
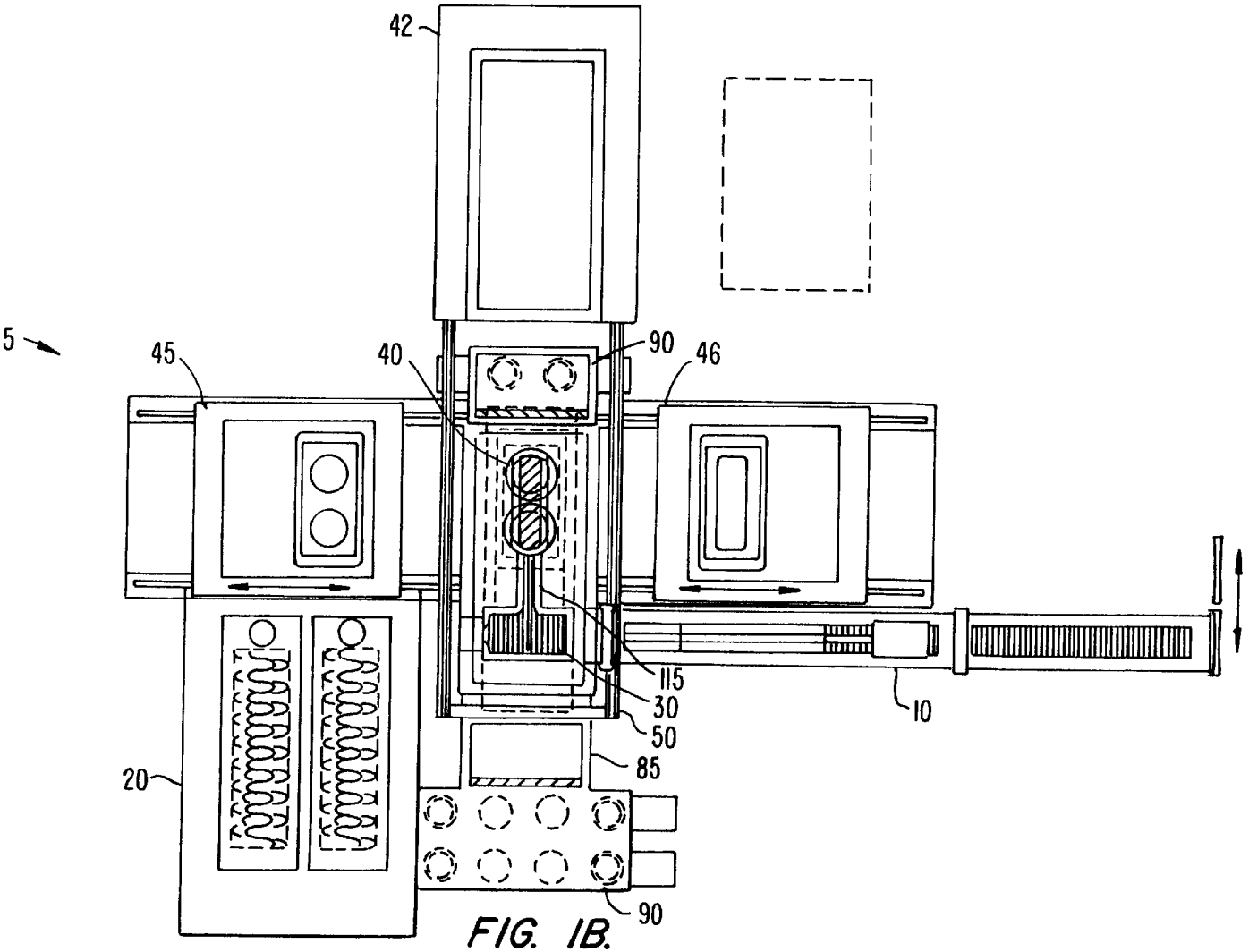
FIG. 1*b* is a top view of a cold hearth refining furnace and surrounding support systems.
Figure 2:
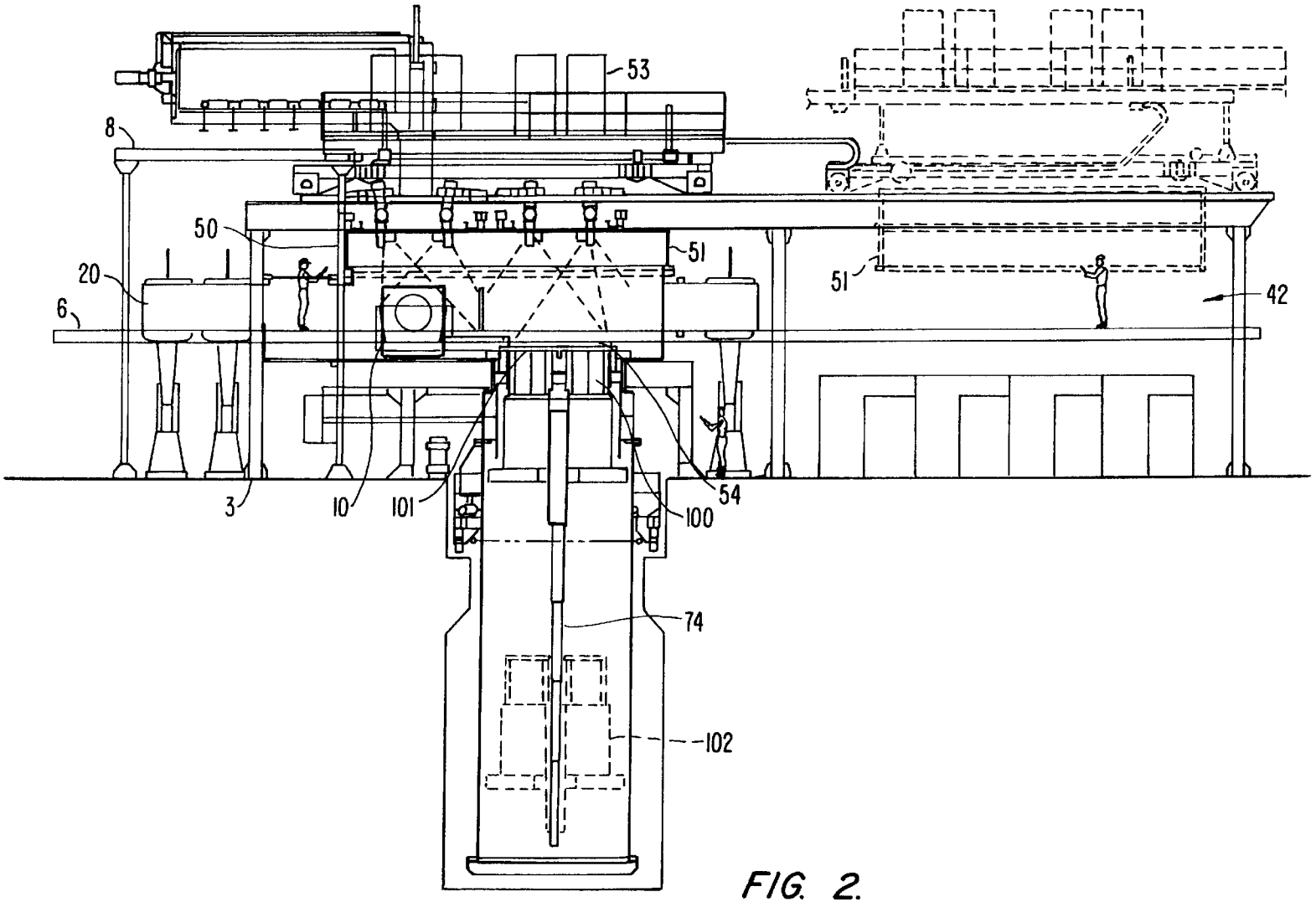
FIG. 2 is a cross-sectional view of the furnace shown in FIG. 1*b;*

FIG. 1*b* is a top view of a cold hearth furnace 5 and material handling area. FIG. 1*b* is intended to illustrate the overall arrangement of the furnace when viewed from above, together with surrounding support equipment. Titanium raw material is supplied to the furnace 5 by electrode or bar material feeder 10 and, in some embodiments, by titanium sponge or scrap feeder 20. In the furnace 5 the titanium is melted and flows generally from the lower portion of FIG. 1*b* toward the upper portion. After refining the materials is solidified into desired shapes using single or multiple molds of various configurations. The solidified ingot is withdrawn into the lower chamber. (The casting operation is illustrated in FIG. 2 and described below.) Carts 45 and 46 are provided for removal and transport of the cast ingots after solidification. In addition, space is allowed around the furnace for a maintenance station 42 for servicing the furnace lid, for electron beam guns and for related systems.

The furnace 5 shown in FIG. 1*b* includes several major components—an enclosure 50 to maintain the desired environmental conditions within the furnace, a melting hearth 30 for melting the titanium and a casting area 40 containing molds for casting the titanium into desired shapes. Generally, titanium feedstock, titanium scrap, titanium sponge, or other solid material containing titanium, or material containing a desired element with which to alloy the titanium, is introduced by one or both of material feeders 10, 20 into melting hearth 30. Melting hearth 30 receives energy from heating sources to melt the raw titanium. The titanium is melted, preferably using electron beam guns or plasma torches, but other heat sources may also be employed. Once melted in hearth 30, the titanium flows through a transport hearth 115 into the mold chamber 40 where it is cast into a desired shape. As the titanium progresses through the furnace, vaporized impurities are removed by vacuum pumps 90, illustrated schematically.

Not shown in FIG. 1*b* is a control room where operators and equipment for controlling the furnace are situated. A lid and gun maintenance station 42 is also illustrated. When the furnace is to be cleaned or otherwise maintained, the upper portion of the furnace (not shown) is removed and positioned at the maintenance station to permit access to the furnace. When maintenance is required on the electron beam guns (described below) which are used to melt the titanium, this may also be performed at the maintenance station.

The diagram of FIG. 1*b* also illustrates the use of different molds and different carts for the finished titanium product. The titanium flows into the casting area 40 where it is cast into desired shapes. Cart 45 is illustrated as holding two cylindrical ingots, while the cart 46 is illustrated as holding a single rectangular slab.

FIG. 1*b* also illustrates one arrangement for vacuum pumps 90. Eight of the pumps are shown at the feed end of the furnace, and two pumps are shown at the casting end of the furnace. The vacuum pumps 90, such as oil vapor booster pumps, diffusion pumps, blowers, and mechanical pumps will maintain a chamber vacuum sufficient to operate the electron beam guns and perform refining. This arrangement has the advantage of extracting more of the impurity containing vapor at the melting end of the hearth where it originates. Because most of the evaporation of impurities, for example magnesium chlorides, occurs at the main hearth, additional vacuum pumps are placed in that region. This minimizes the movement of impurity toward the casting portion of the furnace, where the impurity could result in defects in to the titanium being cast. A condensate trap 85 separates the vacuum pumps from the melting hearth 30. The condensate trap preferably comprises a collector, and underlying catch basin upon which particulate or gaseous materials in the atmosphere of the furnace deposits or condenses. This prevents the material from entering the vacuum pumps, improving the performance of the pumps. Using the system described in conjunction with FIG. 1*a,* the collector may be periodically removed for cleaning or replacement.

FIG. 2 is a cross-sectional view of the titanium refining furnace shown in top view in FIG. 1*b*. The supporting structure 3 is illustrated diagrammatically, and has an upper surface 6 where the furnace is situated. Enclosure 50 contains the furnace. The bar feeder 10 and scrap feeder 20 described above are illustrated on the left-hand side of the drawing. A track and accompanying trolley 8 are illustrated above the enclosure 50. The trolley is used to hoist the lid 51 of the enclosure 50 off the enclosure 50 for transportation to the maintenance station 42. Various support equipment for operating the furnace, such as power supplies, water and vacuum systems, and other utilities 53 are situated above the enclosure 50.

FIG. 2 further illustrates the manner by which cast titanium is removed from the furnace. After the titanium is refined, it flows downward into the mold chamber 100 and solidifies into an ingot of the desired configuration. FIG. 2 illustrates the mold chamber 100 in its retracted position 102 from enclosure 50. During the molding process the upper surface 101 of the molding chamber 100 is brought into contact with the lower surface 54 of enclosure 50. The two surfaces are joined together and sealed, enabling the vacuum pumps coupled to enclosure 50 to lower the pressure in the mold chamber 100. The hydraulic lift 74, at this time, will be fully extended so that the lower surface of the mold is in its upper position for casting the ingot. As the titanium is cast, the hydraulic lift 74 retracts. Once the molding process is completed, no additional titanium is refined, and the hydraulic lift is retracted to the position illustrated in FIG. 2. The mold chamber 100 is then separated from the furnace enclosure 50 as illustrated. One of the carts, for example, cart 45, illustrated in FIG. 1*b,* may then be used to remove the cast material and the molding chamber from the position beneath the furnace. Once this occurs, another cart 46, also illustrated in FIG. 1*b,* may be moved into position for the next casting.

Figure 3:
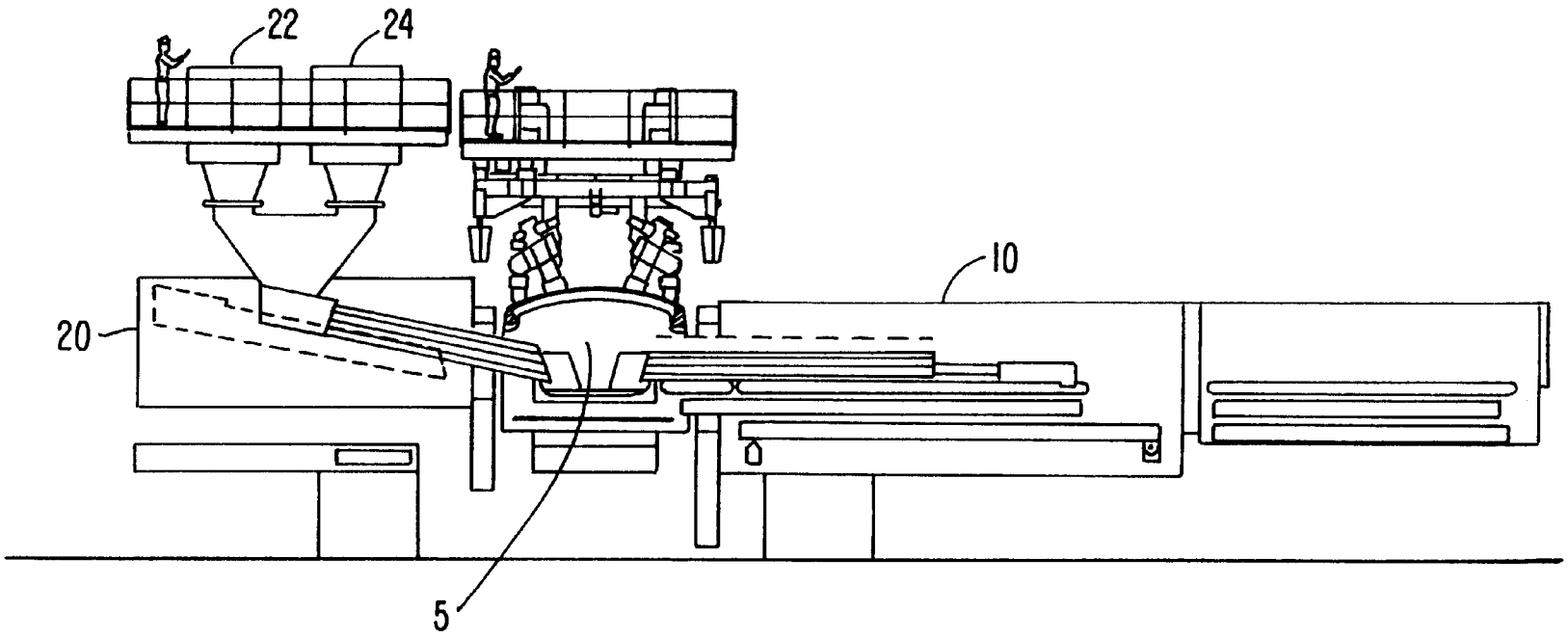
FIG. 3 is another cross-sectional view of the cold hearth refining furnace.

FIG. 3 is a schematic illustration showing additional detail of the furnace depicted generally in FIGS. 1*b* and 2. The solid titanium material is introduced into the furnace 5 in FIG. 3 from one or more feeders 10, 20. In the depicted embodiment two feeders are employed. Preferably, each of the feeders is itself a dual feeder in the sense that each feeder includes a load lock to enable it to provide two separate sources of material. The use of dual feeders enables one portion of the dual feeder to be loaded with raw material and pumped down to a vacuum, while the other portion is employed to introduce titanium into the melting chamber. Feeder 10 is a dual bar or electrode feeder, while feeder 20 is a dual particulate feeder, feeding material from one or the other of feeders 22, 24. The solid pieces supplied from feeder 20 can consist of small scraps of titanium containing material to be recycled. The electrode feeder, in contrast, typically is used for introduction of a bar or ingot of titanium or a fabricated assembly of smaller pieces.

The raw material is introduced into the vacuum (or controlled atmosphere) enclosure of the furnace using a load lock or other similar approach. In some embodiments of the invention, scrap titanium entering from feeder 20 is preferably introduced by being brought into a hopper which pivots to deposit the titanium pieces into the molten bath present in the melting hearth 30. The hopper minimizes splashing and splattering of the molten titanium. In the case of a rod or bar being introduced from the electrode feeder 10, the material is continuously melted from the end of the rod or bar using an electron beam gun or plasma torch as it arrives at the melting hearth 30.

In addition to feeding unrefined solid titanium, feeders 10 and 20 can be used to introduce desired metals for alloying with the titanium. For example, using the feeders aluminum may be introduced to create a titanium-aluminum alloy. The feeders are also typically coupled to weight scales to enable measurement of the amount of titanium or other material introduced, thereby allowing close control of the constituents of the desired alloy. In one embodiment the particulate feeder is on the order of 12 feet by 6 feet by 12 feet, while the electrode feeder is about eight feet by 4 feet by 14 feet. The melting hearth will be on the order of 5 feet by 5 feet by 3 feet deep.

An important advantage of having multiple feeders is that raw titanium may be loaded from both sides of the furnace with independently controllable feed rates. This allows the composition of the cast titanium to be varied, for example, by enriching with certain elements depending on the alloy desired.

Figure 4:
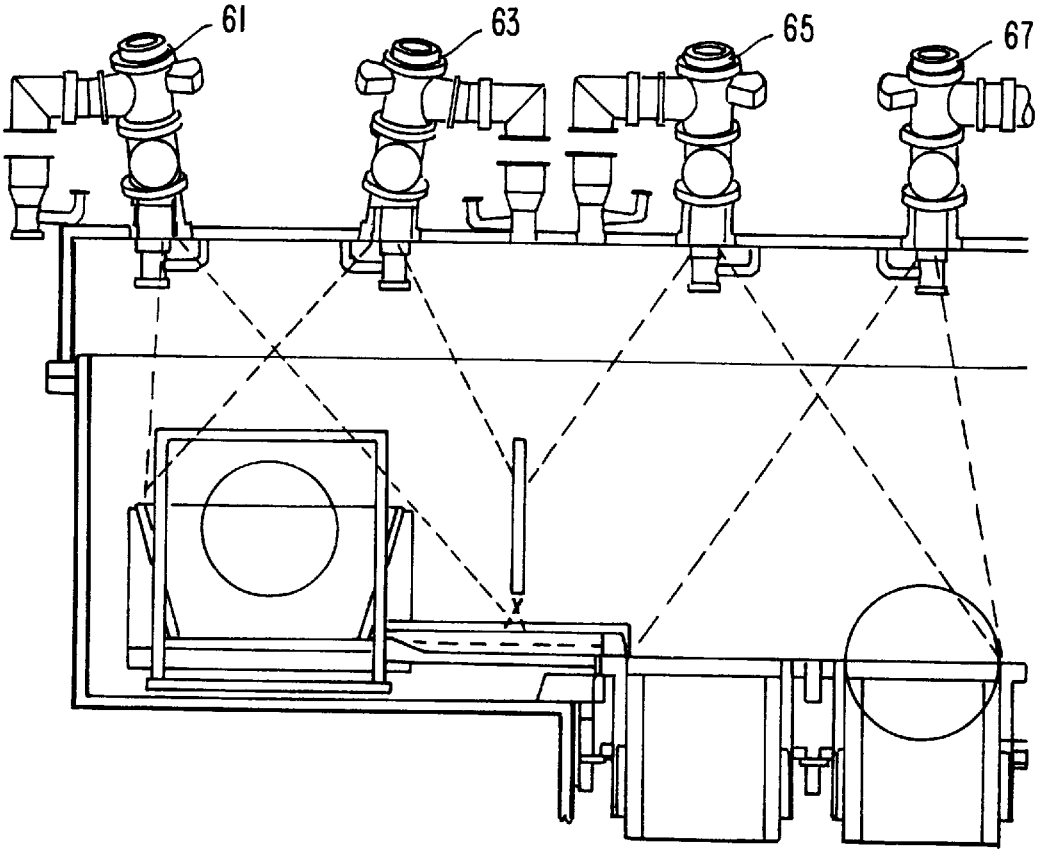
FIG. 4 illustrating how the electron beam guns can be aimed to maintain the titanium in a molten condition.

FIG. 4 illustrates how the titanium is maintained in a molten state by a configuration of energy sources or heating sources 61–68. Sources 62, 64, 66 and 68 are hidden behind source 61, 63, 65 and 67, respectively. In a preferred embodiment, the heating sources are electron beam guns operating at about 600–750 kilowatts. These electron beam guns are sufficient to maintain the titanium in a molten condition throughout the entire hearth. Because the furnace 5 is a cold hearth furnace, the hearth of the furnace will be cooled by a desired coolant 125 (See FIG. 5) such as water. In this manner a layer of solid titanium is formed adjacent the hearth surfaces, forming the skull to separate the molten titanium from the hearth. As the molten titanium flows across the skull, more volatile contaminants within the titanium are vaporized, while higher density contaminants settle to the bottom. Vacuum diffusion pumps 90 (see FIG. 1*b*) coupled to enclosure withdraw the vaporized contaminants, thereby purifying the titanium. Because the material initially introduced into the furnace has more contaminants, and therefore produces more impurity gas, more pumps are employed at the upstream end of the system. This is described further below.

The electron beam guns, or other heat sources, must raise the temperature of the solid titanium introduced into the chamber to at least the melting temperature, approximately 1650° C. Typically, this is achieved by electron guns 61–64. As the titanium flows from the melting chamber 30, additional electron beam guns 65–68 maintain the titanium in a molten condition. These electron beam guns are disposed asymmetrically around the flow path, and the beam from each can be aimed or swept about the desired region of the furnace hearths. This enables all portions of the hearth to be heated. The number of electron beam guns is chosen to provide redundancy, enabling one or more to fail, or be turned off for maintenance without terminating the refining process.

Figure 7:
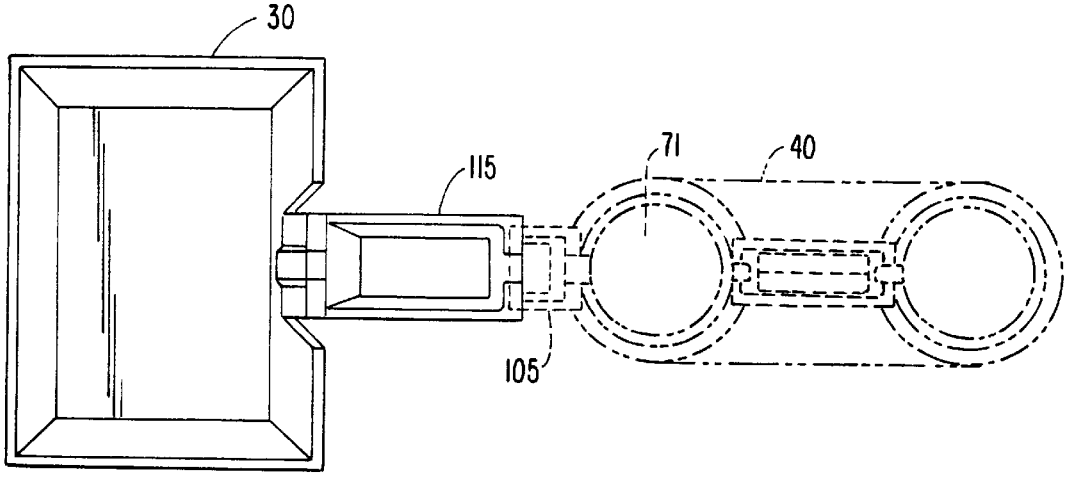
FIG. 7 is a top view of one embodiment of the invention employing a transport hearth and reservoir.

In the illustration of FIG. 7, a transport hearth 115 connects the melting hearth 30 with the casting zone 122 of the furnace. The casting zone is shown as casting an ingot 71. This ingot is cast by allowing the molten titanium to flow through the hearth into a cylindrical mold. Once in this mold the titanium cools and solidifies. As has been described, any desired mold configuration can be employed. The cylindrical mold is used only for the purpose of explanation.

Figure 5:
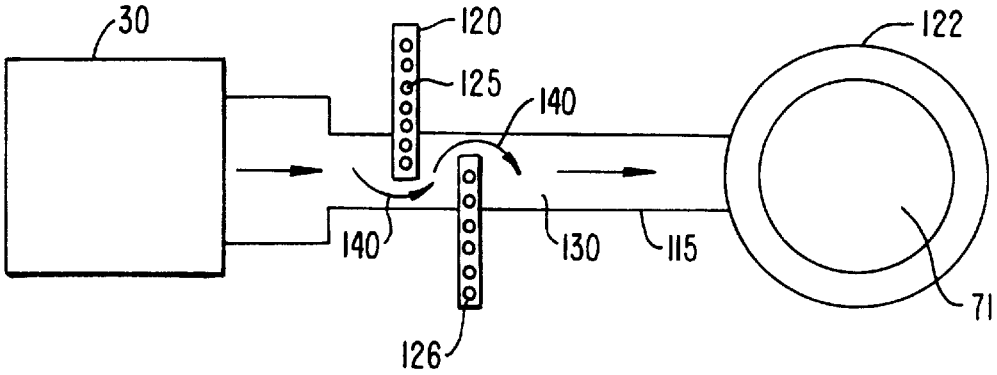
FIG. 5 is a top view illustrating the barrier arrangement.

FIG. 5 illustrates another aspect of the furnace of this invention. In the preferred embodiment, a pair of barriers 120, 126 extend into the molten titanium at a desired location in the transport hearth 115, between the melting hearth 30 and the casting region 122 to partially block the flow of the titanium. In this illustration a single large diameter cylindrical ingot 71 is being cast. These barriers 120, 126 cause the molten titanium flowing from the melting hearth to take a circuitous path 140 before flowing into the mold chamber 40. This path introduces turbulence for the molten titanium and allows additional impurities to be removed by vaporization of the impurities at the surface of the titanium, by dissolution, or by sinking to the bottom of the hearth. Additionally, the barriers prevent splattering of titanium from the melting hearth or feeders, where it is relatively impure, into the casting chamber, where it is relatively pure.

Figure 6:
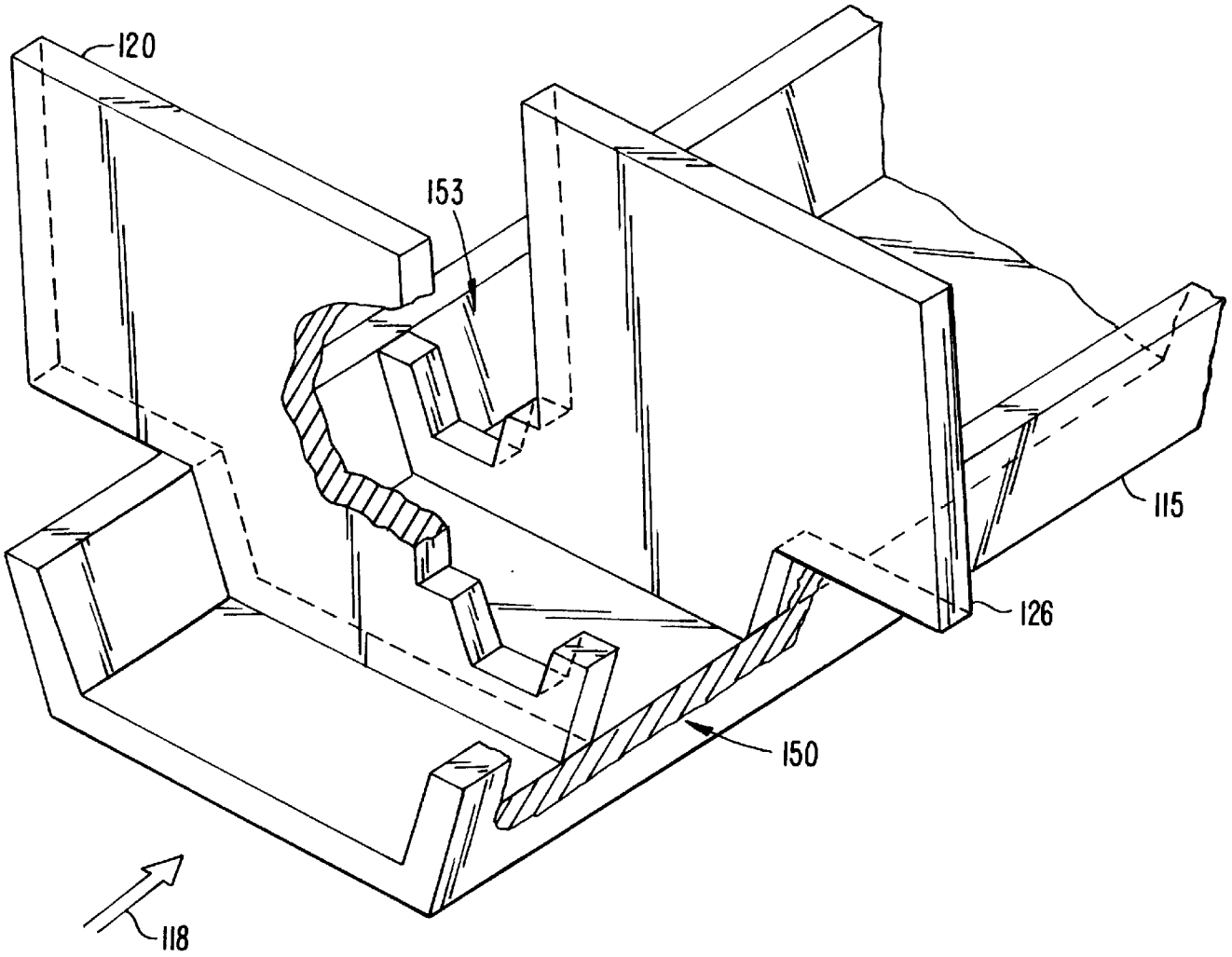
FIG. 6 is a perspective view of one embodiment of the barriers used to mix the molten titanium.

FIG. 6 illustrates in additional detail the barriers 120 and 126 described above, together with the transport hearth 115. The structure illustrated in FIG. 6 is particularly beneficial for casting highly pure titanium alloys. The titanium flow through the structure shown in FIG. 7 is in the direction of arrow 118. The first barrier 120 includes a notch, shown generally in region 150. The second barrier 126 includes a similar notch 153, but positioned on the opposite side of the transport hearth 115. The provision of the barriers and notches creates a torturous path for the metal flow and forces a vertical cascade from one section of the hearth to the next. The cascade is achieved because notch 150 is spaced apart a slightly greater distance from the floor of the hearth than the notch 153. In other words notch 153 is closer to the bottom of the hearth 115. This helps trap impurities which are heavier than the titanium, and have therefore sunk to the bottom of the hearth, and prevent them from flowing on into the casting region. An additional advantage of the structure is that the titanium skull which solidifies against the hearth and barriers is divided into three separate pieces, and none of the three are frozen around the barriers. This enables easier removal of the skull when necessary.

FIG. 7 illustrates another embodiment of the hearth. Shown in FIG. 7 is the melting hearth 30 and the transport hearth 115. Also depicted is the casting region and mold chamber 40. Situated between the transport hearth 115 and the molding region 40 is a reservoir hearth 105. The reservoir is provided at the feed level at the first ingot molding region 71. Because the reservoir 105 is at a slightly lower elevation than the transport hearth 115, there will be a cascade of molten titanium from the transport hearth to the reservoir hearth. The reservoir hearth, however, is at the same elevation as the first ingot mold 71. This enables titanium to flow in a horizontal manner into the mold 71. In this manner deterioration of the ingot surface from a cascading flow is minimized.

A frequently encountered problem in feeding scrap titanium into refining furnaces is splashing and splattering. As pieces of titanium feedstock strike the molten bath, splattering occurs, which if not controlled, may contaminate the refined titanium. In addition, the splattering creates the need for the furnace to be cleaned more frequently.

The foregoing has been a description of a preferred embodiment of the invention. It will be appreciated that many modifications to the embodiments depicted may be made without departing from the spirit of the invention. For example, although the description has been in terms of titanium refining, other metals may also be refined using the process and apparatus described.

What is claimed is:

1. A cold hearth furnace comprising:

a melting hearth into which raw material is introduced to be melted;

a transport hearth connected to the melting hearth for receiving the melted raw material therefrom, the melting hearth and the transport hearth being linearly arranged;

a mold coupled to the transport hearth for receiving the melted material; whereby the raw material is melted in the melting hearth and flows through the transport hearth into the mold; and first and second partial barriers disposed between the melting hearth and the mold, each barrier extending into the flow of the raw material;

wherein the barriers cause the material melted to flow in a non-linear pattern between the melting hearth and the mold.

2. A furnace as in claim 1 wherein:

the melting hearth comprises a region having a first surface area with a first width and first length, the first length being in the direction of flow of the material; and the transport hearth comprises a region having a second surface area with a second width and second length, the second length also being in the direction of flow of the material, and wherein the second width is smaller than the first width.

3. A furnace as in claim 2 wherein the partial barriers extend into the flow of the material in the transport hearth.

4. A furnace as in claim 2 wherein the barriers are spaced apart from each other and extend from opposite sides of the transport hearth to thereby force the melted material to flow in a circuitous manner.

5. A furnace as in claim 4 wherein the barriers are disposed parallel to each other and spaced apart by a distance less than the width of the transport hearth.

6. A furnace as in claim 2 wherein the barriers block material spattered during the melting of the raw material from reaching the receptacle.

7. A furnace as in claim 2 wherein:

each of the melting hearth and the transport hearth have a bottom; and the barriers extend from the surface of the melted material to the bottom of the hearth.

8. A furnace as in claim 1 wherein:

the melting hearth includes a first series of heat sources for melting the raw material; and the transport hearth includes a second series of heat sources for maintaining the raw material in a molten state.

9. A furnace as in claim 8 wherein the heat sources comprise electron beam guns.

10. A furnace as in claim 9 wherein the electron beam guns are arranged in a manner to maintain the material in a molten condition in the melting hearth and the transport hearth but in a solid condition along walls and bottom of the melting and the transport hearths.

11. A cold hearth furnace comprising:

a first segment having a first end into which raw material is introduced to be melted, and having a second opposite end, the first segment having a first surface area with a first width and first length, the first length being in the direction of flow of the material;

a second segment having a first end connected to the second end of the first segment for receiving the melted raw material therefrom, and having a second opposite end, the second segment having a second surface area with a second width and second length, the second length also being in the direction of flow of the material, and wherein the second width is smaller than the first width, the first and second segments being linearly arranged;

a receptacle connected to the second end of the second segment for receiving the melted material therefrom; whereby the raw material is melted in the first segment and flows through the second segment into the receptacle; and first and second partial barriers disposed between the first end of the first segment and the receptacle, each barrier extending into the flow of the raw material in the second segment, and being spaced apart spaced apart from each other a distance smaller than the width of the second segment at that location and extending from opposite sides of the furnace to thereby force the melted material to flow in a circuitous manner.

12. A furnace as in claim 11 wherein:

the first segment includes a first series of electron beam guns for melting the raw material; and the second segment includes a second series of electron beam guns for maintaining the raw material in a molten state.

13. A cold hearth furnace comprising:

a melting hearth into which raw material is introduced to be melted;

a transport hearth connected to the melting hearth for receiving the melted raw material therefrom;

a mold coupled to the transport hearth for receiving the melted material; whereby the raw material is melted in the melting hearth and flows through the transport hearth into the mold; and a vacuum system including at least a first set and a second set of vacuum pumps coupled to the furnace for reducing the pressure therein, the first pump set being disposed nearer the melting hearth than the mold, and the second pump set being disposed nearer the mold than the melting hearth, the first pump set having a larger capacity than the second pump set.

14. A furnace as in claim 13 wherein the vacuum pumps comprise oil vapor booster pumps.

15. A furnace as in claim 13 wherein the first set of vacuum pumps comprise at least three pumps and the second set comprises at least two pumps.

16. A cold hearth furnace comprising:

a melting hearth into which raw material is introduced to be melted;

a first material feeding apparatus and a second material feeding apparatus, each connected to supply raw material to the melting hearth;

a transport hearth connected to the melting hearth for receiving the melted raw material therefrom;

a mold coupled to the transport hearth for receiving the melted material; whereby the raw material is melted in the melting hearth and flows through the transport hearth into the mold;

first and second partial barriers disposed between the melting hearth and the mold, each barrier extending into the flow of the raw material to cause the material melted to flow in a non-linear pattern between the melting hearth and the mold; and wherein the first material feeding apparatus is adapted to feed bar stock to the melting hearth and the second material feeding apparatus is adapted to feed scrap stock to the melting hearth.

17. A furnace as in claim 16 wherein:

the melting hearth is operated at a reduced pressure; and at least one of the first material feeding apparatus and the second material feeding apparatus includes a load lock to enable it to be closed after raw material is introduced thereto, then lowered in atmospheric pressure to approximately the reduced pressure before the raw material is supplied to the melting hearth.

18. A furnace as in claim 17 wherein both of the first material feeding apparatus and the second material feeding apparatus include load locks to enable each to be closed after raw material is introduced thereto, then lowered in atmospheric pressure to approximately the reduced pressure before the raw material is supplied to the melting hearth.

19. A furnace as in claim 18 wherein both of the first material feeding apparatus and the second material feeding apparatus are configured to supply raw material simultaneously to the melting hearth.

20. A cold hearth furnace comprising:

a melting hearth into which raw material is introduced to be melted;

a transport hearth connected to the melting hearth for receiving the melted raw material therefrom, the melting hearth and the transport hearth being linearly arranged;

a reservoir hearth coupled to the transport hearth for receiving the raw material therefrom, the reservoir hearth being disposed below the transport hearth to receive material therefrom and essentially level with a mold to thereby enable substantially horizontal flow between the reservoir hearth and an upper surface of the mold; and the mold coupled to the reservoir hearth for receiving the melted material; whereby the raw material is melted in the melting hearth and flows through the transport hearth into the reservoir hearth and then into mold; and a vacuum system including at least a first set and a second set of vacuum pumps coupled to the furnace for reducing the pressure therein, the first pump set being disposed nearer the melting hearth than the mold, and the second pump set being disposed nearer the mold than the melting hearth, the first pump set having a larger capacity than the second pump set.

21. A cold hearth furnace comprising:

a melting hearth into which raw material is introduced to be melted;

a transport hearth connected to the melting hearth for receiving the melted raw material therefrom;

a mold coupled to the transport hearth for receiving the melted material; whereby the raw material is melted in the melting hearth and flows through the transport hearth into the mold;

a vacuum system coupled to the furnace for reducing the pressure therein, the vacuum system including at least a first set and a second set of vacuum pumps coupled to the furnace for reducing the pressure therein, the first pump set being disposed nearer the melting hearth than the mold, and the second pump set being disposed nearer the mold than the melting hearth, the first pump set having a larger capacity than the second pump set; and a condensate trap disposed between the melting hearth and at least a portion of the vacuum system for reducing the quantity of vapor containing condensates from being processed by the vacuum system.

22. A system as in claim 21 wherein the condensate trap further comprises:

a collector for causing gaseous materials to condense thereon; and a catch basin disposed thereunder for collecting materials condensing on the collector.

23. A cold hearth furnace comprising:

a melting hearth into which raw material is introduced to be melted;

a transport hearth connected to the melting hearth for receiving the melted raw material therefrom, the melting hearth and the transport hearth being linearly arranged;

a reservoir hearth coupled to the transport hearth for receiving the raw material therefrom, the reservoir hearth being disposed below the transport hearth to receive material therefrom and essentially level with a mold to thereby enable substantially horizontal flow between the reservoir hearth and an upper surface of the mold;

the mold coupled to the reservoir hearth for receiving the melted material; whereby the raw material is melted in the melting hearth and flows through the transport hearth into the reservoir hearth and then into mold; and first and second partial barriers disposed between the melting hearth and the mold, each barrier extending into the flow of the raw material to cause the material melted to flow in a non-linear pattern between the melting hearth and the mold.

24. A cold hearth furnace as in claim 23 further comprising:

a vacuum system coupled to the furnace for reducing the pressure therein; and a condensate trap disposed between the melting hearth and at least a portion of the vacuum system for reducing the quantity of vapor containing condensates from being processed by the vacuum system.

25. A system as in claim 24 wherein the condensate trap further comprises:

a collector for causing gaseous materials to condense thereon; and a catch basin disposed thereunder for collecting materials condensing on the collector.

26. A cold hearth furnace comprising:

a melting hearth into which raw material is introduced to be melted;

a first material feeding apparatus and a second material feeding apparatus, each connected to supply raw material to the melting hearth, the first material feeding apparatus being adapted to feed bar stock to the melting hearth and the second material feeding apparatus being adapted to feed scrap stock to the melting hearth;

a transport hearth connected to the melting hearth for receiving the melted raw material therefrom;

a mold coupled to the transport hearth for receiving the melted material; whereby the raw material is melted in the melting hearth and flows through the transport hearth into the mold; and a vacuum system including at least a first set and a second set of vacuum pumps coupled to the furnace for reducing the pressure therein, the first pump set being disposed nearer the melting hearth than the mold, and the second pump set being disposed nearer the mold than the melting hearth, the first pump set having a larger capacity than the second pump set.

27. A furnace as in claim 26 wherein:

the melting hearth is operated at a reduced pressure; and at least one of the first material feeding apparatus and the second material feeding apparatus includes a load lock to enable it to be closed after raw material is introduced thereto, then lowered in atmospheric pressure to approximately the reduced pressure before the raw material is supplied to the melting hearth.

28. A furnace as in claim 27 wherein both of the first material feeding apparatus and the second material feeding apparatus include load locks to enable each to be closed after raw material is introduced thereto, then lowered in atmospheric pressure to approximately the reduced pressure before the raw material is supplied to the melting hearth.

29. A furnace as in claim 28 wherein both of the first material feeding apparatus and the second material feeding apparatus are configured to supply raw material simultaneously to the melting hearth.

* * * * *